US010881587B2

(12) United States Patent
Shastri et al.

(10) Patent No.: US 10,881,587 B2
(45) Date of Patent: Jan. 5, 2021

(54) PARTITIONING COMPONENT FOR A FEEDING BOTTLE DEVICE AND FEEDING BOTTLE DEVICE

(71) Applicant: KONINKLIJKE PHILIPS N.V., Eindhoven (NL)

(72) Inventors: Narasimha Shastri, Eindhoven (NL); Johannes Tseard Van Der Kooi, Munein (NL); Jacob Cornelis Paul Den Dulk, Eindhoven (NL); Arnold Aalders, Sprang Capelle (NL); Bryan Keith Windus-Smith, Bury St Edmunds (GB); Carolien Willemijn Geijzendorffer, Mussel (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/337,205

(22) PCT Filed: Mar. 5, 2018

(86) PCT No.: PCT/EP2018/055241
§ 371 (c)(1),
(2) Date: Mar. 27, 2019

(87) PCT Pub. No.: WO2018/162366
PCT Pub. Date: Sep. 13, 2018

(65) Prior Publication Data

US 2019/0380916 A1 Dec. 19, 2019

(30) Foreign Application Priority Data

Mar. 9, 2017 (EP) ..... 17160142

(51) Int. Cl.
*A61J 11/02* (2006.01)
*A61J 11/04* (2006.01)
*A61J 9/04* (2006.01)

(52) U.S. Cl.
CPC ..... *A61J 11/02* (2013.01); *A61J 9/04* (2013.01); *A61J 11/04* (2013.01)

(58) Field of Classification Search
CPC . A61J 11/02; A61J 11/04; A61J 11/045; A61J 9/04; A61J 9/00; A47G 19/2272; B65D 51/1644
(Continued)

(56) References Cited

U.S. PATENT DOCUMENTS 5,747,083 A 5/1998 Raymond
7,044,316 B1 5/2006 Hsu
(Continued)

FOREIGN PATENT DOCUMENTS

BE 881099 A 5/1980
CN 202478212 U 10/2012
(Continued)

*Primary Examiner* — Robert J Hicks

(57) ABSTRACT

A partitioning component for a feeding bottle device. The feeding bottle device comprising a teat component defining a teat volume therein and a container component defining a container volume therein. The teat component being attachable to the container component by means of an attachment component. The partitioning component comprises a first passage allowing a passage of fluid from the container volume to the teat volume and a second passage allowing a passage of fluid from the teat volume to the container volume, wherein the second passage is provided in the form of a one-way passage. The invention further relates to a corresponding feeding bottle device and a feeding method. The solutions according to the invention reduce the risk of colic-like symptoms for the infant.

21 Claims, 7 Drawing Sheets

(58) Field of Classification Search
USPC ..... 215/11.5, 11.4, 11.6, 355; 220/203.02, 220/203.01, 203.19, 203.21, 203.2, 303, 220/304, 802, 804, 801; 606/236
See application file for complete search history.

(56) References Cited

U.S. PATENT DOCUMENTS

| | | | | |
|---|---|---|---|---|
| 7,938,281 | B2 * | 5/2011 | Horntrich | A61J 9/00 215/11.1 |
| 8,091,730 | B2 * | 1/2012 | Keefe | A47G 19/2272 220/203.18 |
| 8,960,465 | B2 | 2/2015 | Pfenniger | |
| 9,161,886 | B2 | 10/2015 | Haberman | |
| 2004/0089626 | A1 * | 5/2004 | Pyun | A61J 9/006 215/11.5 |
| 2009/0014403 | A1 | 1/2009 | Lu | |
| 2010/0314347 | A1 * | 12/2010 | Haberman | A61J 9/04 215/6 |
| 2011/0000928 | A1 * | 1/2011 | Antier | B65D 55/024 220/801 |
| 2011/0042339 | A1 | 2/2011 | Pfenniger | |
| 2016/0354287 | A1 | 12/2016 | Britto | |
| 2017/0066569 | A1 * | 3/2017 | Wiesman | B65D 47/0885 |

FOREIGN PATENT DOCUMENTS

| | | | |
|---|---|---|---|
| CN | 2087965 | U | 11/2014 |
| CN | 204170115 | U | 2/2015 |
| DE | 507836 | C | 9/1930 |
| EP | 2224893 | B1 | 9/2010 |
| EP | 2799058 | A1 | 11/2014 |

* cited by examiner

PARTITIONING COMPONENT FOR A FEEDING BOTTLE DEVICE AND FEEDING BOTTLE DEVICE

This application is the U.S. National Phase application under 35 U.S.C. § 371 of International Application No. PCT/EP2018/055241, filed on Mar. 5, 2018, which claims the benefit of International Application No. 17160142.0, filed Mar. 9, 2017. These applications are hereby incorporated by reference herein.

FIELD OF THE INVENTION

The invention relates to a partitioning component for a feeding bottle device and a feeding bottle device comprising the partitioning component. The invention relates in particular to a partitioning component for a feeding bottle device for feeding an infant. It finds application in the field of reducing the likelihood of colic-like symptoms, wherein it also applies to other fields.

BACKGROUND OF THE INVENTION

Colic is a condition some infants suffer from during early months after birth, wherein presence of air in the digestive system is indicated as a major cause. Air ingestion is unavoidable both in breast-feeding and bottle-feeding due to the presence of vacuum in the infant's mouth during feeding. However, it is desired to reduce the amount of air ingested by the infant in order to prevent or alleviate colic-like symptoms.

Different strategies are used to minimize air ingestion during feeding, including reducing the effort required by the infant, for instance by reducing the vacuum through providing a venting valve in the bottle. However, air can nevertheless enter into a teat region of the feeding bottle device in case the liquid level within the feeding bottle drops below a certain level and/or the feeding bottle is provided to the infant in a horizontal position, i.e. a volume around the teat region will then only partially be filled by liquid.

EP2799058A1 discloses a feeding apparatus comprising a container and a flexible feeding teat for drawing milk from the bottom of the feeding apparatus when the feeder is held in the operating position. A flow restrictor for allowing the passage of liquid feed from a main container chamber into the flexible feeding teat is positioned at a suitable location. The flow restrictor allows that vacuum induced from the infant's sucking on the teat results in liquid being drawn into the teat from the main container chamber. Due to the suitable location of the flow restrictor, a filling level of the teat can be kept high, even at a later feeding stage, i.e. when the amount of liquid in the feeding apparatus gets lower.

However, the known feeding apparatus still carries a risk that air is present within the teat volume, for instance air that entered the teat volume through the teat hole when the infant releases the latch, air that entered the teat volume in the form of bubbles present in the liquid drawn via the flow restrictor and the like. Even further, the user manually has to press a part of the teat to fill it before the feeding and to drain it after the feed, which is inconvenient to the user and carries the risk of air remaining in the teat. This air however eventually can be ingested by the infant and bring along undesired and possibly health threatening colic-like symptoms.

DE 507 836 discloses a baby milk bottle with a valve device, characterized in that the closure of the passages in the valve plate is effected by means of mushroom-shaped rubber valve bodies.

CN 204 170 115 U discloses a positive anti-inflation milk-bottle of suck-back comprising a bottleneck, a breather valve being covered on nipple above the bottleneck and being arranged in an automatic bottle cap. The anti-inflation milk bottle of positive suck-back no matter if upside or inverted allows that outside air is entered by a check valve on the nipple, the passage that jointly forms via the nipple, and the automatic bottle cap.

SUMMARY OF THE INVENTION

It has therefore been an object of the present invention to reduce the risk of colic-like symptoms for the infant while feeding using a feeding bottle device.

In a first aspect a partitioning component for a feeding bottle device is provided. The feeding bottle device comprises a teat component defining a teat volume therein and a container component defining a container volume therein, the teat component being attachable to the container component by means of an attachment component. The partitioning component is configured to separate the teat volume from the container volume when the feeding bottle device is assembled. The partitioning component comprises a first passage allowing a passage of fluid from the container volume to the teat volume and a second passage allowing a passage of fluid from the teat volume to the container volume, wherein the second passage is provided in the form of a one-way passage. The first passage and the second passage are integrated within the partitioning component.

Since the partitioning component comprises two oppositely directed passages, i.e. the first passage and the second passage, liquid from the container volume can fill up the teat volume via the first passage, while air possibly present in the teat volume can escape into the container volume via the second passage, for instance. Thereby, the amount of air in the teat volume and therefore the amount of air which can be ingested by the infant is reduced, which results in less risk of colic-like symptoms for the infant.

Since the second passage is provided in the form of a one-way passage, no passage of fluid is possible from the container volume to the teat volume through the second passage. Additionally, also the first passage can optionally be provided in the form of a one-way passage which only allows the passage of fluid from the container volume to the teat volume.

Further, since the first passage and the second passage are integrated within the partition component, no additional parts or elements are to be assembled with the partition component in order to provide the oppositely directed passages. Thus, in particular cleaning is facilitated due to the reduced number of components.

The partitioning component and/or the first and second passages preferentially comprise a plastic material in this embodiment, while also other suitable materials can be used in other embodiments.

Teat component, attachment component and container component preferably correspond to similar components known in the context of a prior art feeding bottle device. For instance, the attachment component can comprise a screw-ring for attaching the teat component to the container component.

In an embodiment the partitioning component further comprises an orientation indicator configured to be visually noticeable when the feeding bottle device is assembled. Using the orientation indicator, which is preferably to be positioned upside when the feeding bottle device is in an operating or feeding position, the orientation of the partitioning component and therefore directly the orientation of the first and second passages is known. Thereby, a smooth operation of the feeding bottle device and the partitioning component can be ensured. In other embodiments, the orientation indicator can additionally or alternatively be noticeable acoustically, such as by beeping in case it is incorrectly positioned, through vibration, or the like. While a position upside the feeding bottle device is exemplarily described for the orientation indicator, also alternative or additional positions, such as a position on a side or on the lower side of the feeding bottle device are contemplated. Likewise, a plurality of indication indicators at different positions can be provided. Also the orientation indicator is preferentially integrated within the partition component such that the number of parts is reduced. This further facilitates the aspect of cleaning and assembling the feeding bottle device.

In a feeding position of the feeding bottle device, the feeding bottle device is not upright with the teat component facing up as in a resting position, but inclined such that the teat component is facing downwards with an angle of typically between 10 and 45 degrees with respect to a horizontal direction. Preferably a plane of the partitioning component is substantially normal to the orientation of the teat component when the feeding bottle device is in the assembled state. This is advantageous over prior art feeding bottle devices, which usually have to be positioned with an inclination exceeding 45 degrees downwards with respect to horizontal direction, i.e. a more vertical orientation pointing downwards. A more vertical orientation of the feeding bottle device results in an unfavorable, since unnatural and more horizontal position of the infant while feeding on the feeding bottle device.

In an embodiment the first passage and the second passage are arranged at different distances from the orientation indicator, respectively. Different distances from the orientation indicator result in different positions of the valves with respect to a liquid level in the container volume, when the feeding bottle device is held in the feeding position. The lower the first passage is positioned, the closer the feeding position of the feeding bottle device can be oriented with respect to the horizontal direction, while the first passage remains below the liquid level in the container volume. Thereby, it can be ensured that the partitioning component maintains the teat volume filled with liquid even at a later stage of feeding, when the container volume is only partially filled. A more horizontal orientation is preferred since it more closely corresponds to the natural feeding position of breast-feeding and the infant can be maintained in a more vertical orientation during feeding, which further reduces the risk of air ingestion and thus colic-like symptoms.

In an embodiment the second passage is arranged closer to the orientation indicator than the first passage. Since the second passage is arranged closer to the orientation indicator, which is preferably to be positioned upside when the feeding bottle device is in the feeding position, the second passage will be positioned above the level of liquid in the container volume, particularly at a later feeding stage and when the feeding position corresponds to a preferred close to horizontal orientation. When air enters the container volume above the liquid level through the second passage, the formation of bubbles in the container volume is avoided. Bubbles formed in the container volume can travel again into the teat volume and can end up in the mouth of the infant. Since in this embodiment already the formation of bubbles is avoided, the risk for air ingestion is further reduced.

In an embodiment at least one of the first passage and the second passage comprises a valve presenting an opening pressure of 10 mbar or below. Expressed differently, the at least one valve is then almost nominally open. Preferably both of the first passage and the second passage comprise a valve, in particular a one-way valve, which is nominally open, i.e. requires no or a very low opening pressure. Accordingly, a vacuum required in the teat volume in order to have liquid drawn into the teat volume through the valve of the first passage from the container volume is very low. More effort from the infant, i.e. a higher required vacuum, would result in a higher risk of air ingestion and the already mentioned undesired effects. With the column of liquid acting from the container volume side on the first passage favoring the passage into the teat volume in the feeding position, the teat volume remains filled with liquid. Further, the liquid filling the teat volume pushes air possibly present in the teat volume through the second passage into the container volume, which is also favored by a low opening pressure of the valve of the second passage. Further preferably, also the closing pressure of at least one valve of the first and second, preferably of the second or of both, passages is very low.

In an embodiment at least one of the first passage and the second passage comprises a flap valve or a duck-bill valve. Flap valves and duck-bill valves are known examples of suitable one-way valves, which in particular comply with the requirements of low opening and low closing pressures. However, in other embodiments, also other forms of one-way valves can of course be used.

In an embodiment the first passage is formed as an opening. While it is a requirement for the second passage to block the passage in one direction, the first passage can allow a bidirectional passage of fluid. An opening is of course just one simple example of a suitable passage and other passages are contemplated.

In an embodiment the first passage comprises an opening with elliptical shape. Advantageously, the elliptical shape of preferably the top side of the opening allows for user errors in rotational positioning. It allows the teat to remain filled for the longest possible time in a broader range of rotational positions of the partitioning component.

In an embodiment the first passage is formed as an opening and the second passage comprises a duckbill valve. The duckbill valve can be integrally formed with the partitioning component without relying on movable parts. Preferably, the partitioning component comprises two polymer materials having different material properties each, wherein a material of the main portion of the partitioning component can then be different from a material of the duckbill valve. It is further preferred that such partitioning component be manufactured using a 2K or two-shot injection molding process, for instance.

In an embodiment the partitioning component further comprises a sealing material for forming a sealing interface between the partitioning component and at least one of the teat component and the container component. Since partitioning component preferably fits between an opening of container component and teat component, partitioning component presents an interface to both the container component and the teat component. Teat component, which is preferably flexible, and container component, which is comparably less flexible, will therefore have different material requirements to provide a sealing interface therewith. Preferably, the sealing material is more flexible than a main material of the partitioning component and is provided in a contact area with the container component. Further preferred, the sealing material is integrated within the partitioning component during manufacture.

In an embodiment the partitioning component further comprises a guiding component for guiding the partitioning component into an opening of the container component. Thereby, assembly of the feeding bottle device is facilitated. Further, the guiding component can provide a resistance against spring forces of other components of the partitioning component, such as an orientation indicator forced against a wall of the container component, and allow a longer durability and lifetime of the partitioning component.

In an alternative embodiment the first passage comprises a first flap valve and the second passage comprises a second flap valve, wherein the first and second flap valves have hinge axes parallel to each other and wherein the flap of the first flap valve is directed facing away from the flap of the second flap valve. Preferably, the hinge axes are arranged in proximity to each other in a central area of the partitioning component and the respective flaps extend from the hinge axes towards the upper and lower side of the partitioning component. Thereby, the first flap valve can preferentially open in proximity to a lower side of the partitioning component and the second flap valve can open in proximity to an upper side of the partitioning component, when an upper side of the partitioning component corresponds to a location of the orientation indicator.

In an embodiment at least one of the first flap valve and the second flap valve is of a circular segmented shape with the chord of the circular segment corresponding to the hinge axis of the respective flap valve. Preferentially, the partitioning component is of circular shape and the circular segmented shape thereby fits with the shape of the partitioning component, which facilitates the positioning of the valves on the partitioning component. Further preferably, a center of the circular segmented shapes of the first and second valves corresponds to the center of the partitioning component, while centers differing from each other can be provided in other embodiments. However, in other embodiments also other shapes of flaps including rectangular or polygonal shapes are of course contemplated.

In an embodiment both the first and the second flap valve are of a circular segmented shape, wherein the sum of the arcs of the circular segmented shapes does not exceed 360 degrees. The sum preferentially sums to less than 360 degrees in proportion to a distance between the hinge axis of the first flap valve and the second flap valve.

In an embodiment the first passage is arranged to protrude from a center plane of the partitioning component into the teat volume and/or the second passage is arranged to protrude from the center plane of the partitioning component into the container volume. The center plane is defined as a plane through a center of the partition component which represents the separation of the teat volume from the container volume by the partition component. In one example, the center plane can correspond to a plane substantially perpendicular to an opening of the container volume, while the center plane can of course also be inclined with respect thereto in other examples, for instance in case the partition component is inclined in an assembled state.

Thereby, the arrangement of the respective passages is facilitated. In one of the preferred embodiments of flap valves, the protrusion can be formed by flaps of the flap valves being provided over a respective opening in the partitioning component, i.e. the flaps are directly provided on opposite sides of the surface of the partitioning component. It is further preferred that a wall normal to the partitioning component and the flap surfaces, which protrudes from the partitioning component in respectively opposite directions and respectively surrounds the first and second flap valves, be provided. This wall serves advantageously as a support for the respective flap of the flap valves in the closed or blocking position.

In a further aspect a feeding bottle device is provided. The feeding bottle device comprises a teat component defining a teat volume therein, a container component defining a container volume therein, a partitioning component according to an aspect of the invention, and an attachment component, the teat component the container component and the partitioning component being attachable to each other along a contact area by means of the attachment component.

The feeding bottle device according to this aspect can be combined with any of the embodiments of the partitioning component described above and will likewise experience the advantageous effects described with reference thereto.

Teat component, attachment component and container component preferably correspond to similar components known in the context of a prior art feeding bottle device. For instance, the attachment component can comprise a screw-ring for attaching the teat component to the container component. In other embodiments, at least two components, such as teat component and attachment component for instance, can also be integrated within one component. In such embodiment, the integrated components are preferably manufactured through injection molding using two different materials having different material properties. Thereby, for instance, the teat can advantageously remain flexible while the attachment portion is less flexible for ensuring a secure attachment to the container component.

In an embodiment the feeding bottle device further comprises at least one air vent valve for allowing the passage of air from outside the feeding bottle device to within the teat volume or the container volume, a confined volume forming component for defining a confined volume within the container volume, wherein the confined volume provides a controlled opening into the container volume, and a duct forming component for forming a guidance duct from the at least one air vent valve to the confined volume.

The at least one air vent valve allows that air enters the teat volume or the container volume to replace liquid drawn from the container volume trough the feeding of the infant, wherein this air does not have to enter into the feeding bottle device through the teat opening, i.e. allows air entering and vacuum reduction even while the infant is latching on the teat. However, air entering through the air vent valve is likely to enter the container volume under the liquid level and therefore results in the formation of bubbles which can end up in the teat and be ingested by the infant.

Since the duct forming component forms a guidance duct from the at least one air vent valve to the confined volume and since the confined volume provides a controlled opening into the container volume, air entering through the air vent valve at an arbitrary position is guided to the confined volume through the annular guidance duct and only then released into the container volume in a controlled manner through the controlled opening. Air entering through the air vent valve can thus be guided to a preferred location, the confined volume, where the chance for a formation of bubbles is reduced. Possible bubbles are accordingly collected and retained separate from the container volume through the confined volume.

Preferably, the duct forming component provides an annular guidance duct around a circumference of the contact area, which includes the at least one air vent valve at an angular position thereof. Since the annular guidance duct is configured to collect the incoming air at the air vent valve independent from the annular position, i.e. a rotational position of the air vent valve, the assembly of the feeding bottle device gets facilitated since the location of the at least one air vent valve does not have to correspond to a particular location or orientation.

In an embodiment the at least one air vent valve is integrated in at least one of the teat component, the container component, the attachment component, the partitioning component and an interface between any two of these components. Since the teat component and the container component are attachable along a contact area, the contact area or an area in proximity to the contact area provides a preferred location for providing an air vent valve for allowing air from outside the feeding bottle device to enter the feeding bottle device and in particular the container volume. Further, since the attachment component is provided to attach the teat component to the container component, the air vent valve integrated therein will preferably also be provided in proximity to the contact area when the feeding bottle device is in an assembled state.

While the air vent valve is preferably integrated in at least one of the teat component, the container component, the attachment component, the duct forming component and an interface between any two of these components, it can also be provided at a separate position and/or with a dedicated component in other embodiments. It should be noted that the air vent valve can be provided in any form suitable for allowing the passage of air but preventing the passage of liquid, such as including a microhole construction which allows the passage of air, a check valve and the like.

In an embodiment the confined volume forming component and the duct forming component are integrated in the partitioning component for dividing the teat volume from the container volume when the feeding bottle device is assembled. Thereby, the number of components to be assembled can be reduced, thus facilitating an assembly of the feeding bottle device.

In an embodiment the confined volume forming component is formed as an orientation indicator, wherein the orientation indicator is visible from outside the feeding bottle device when in an assembled state. Preferably, the orientation indicator is intended to be positioned upside the feeding bottle device when used for feeding, such that the confined volume, which corresponds to the position of the orientation indicator, will also be positioned upside. Thereby, the confined volume will already at a very early stage of feeding, i.e. while the container volume is still significantly filled, be on top of the liquid level, thereby further reducing the amount of air within the liquid to be fed to the infant.

In an embodiment the confined volume is formed by the confined volume forming component and a wall of the container volume in an assembled state of the feeding bottle device.

A shape of the confined volume forming component can be designed such as to fit to the shape of the wall of the container volume to form a confined volume therebetween. For instance, the shape of the confined volume forming component can comprise a U-shape, while a V-shape and any other suitable shape is contemplated. An open, such as U-shaped, space is preferred since cleaning and disinfection is facilitated. However, in other embodiments the confined volume can also be formed by the confined volume forming component alone or in combination with a different component, provided the confined volume forming component participates in this formation.

In an embodiment the guidance duct is formed by the duct forming component of the partitioning component and at least one of the teat component and the container component in an assembled state of the feeding bottle device.

Exemplarily, the opening of the container component and therefore the generally annular contact area can be defined to be in a horizontal plane, in which the partitioning component is to be placed. An annular wall of the container component can therefore exemplarily extend in a substantial vertical direction. In known feeding bottle devices, the teat component forms a seal on an upper edge of the wall of the container component in an assembled state of the feeding bottle device, wherein the teat component at least partially extends vertically and horizontally around the annular contact area. The partitioning component is provided in this annular contact area typically in connection with both the teat component and the container component, preferably in between the teat component and the container component and defining an interface with both the teat component and the container component. Preferably, the duct forming component is in an assembled state of the feeding bottle device such arranged that the guidance duct be formed between the vertical wall of the container component, the horizontal portion of the teat component and the duct forming component. This allows for a simple design of the duct forming component and at the same time ensures that the contact area between teat component and container component, i.e. the feasible area for the location of the at least one air vent valve, be contained within the guidance duct independent of the annular or rotational position of the air vent valve. Preferably, the guidance duct extends over the entire circumference of the contact area and thereby provides an annular guidance duct.

In an embodiment the feeding bottle device further comprises a passage prevention component for preventing liquid from the confined volume to reach the at least one air vent valve. Since the controlled opening allows a fluid passage from the confined volume into the container volume, i.e. a passage of outside air entering via the air vent valve, it should be assured that fluid streaming in the opposite direction, i.e. milk or liquid within the container volume, does not leak from the air vent valve. Preferably, the passage prevention component is integrated within the partitioning component.

Due to the provision of the passage prevention component, fluid leaving from within the confined volume and/or the container volume through the annular guidance duct and the air vent valve is impeded, i.e. the feeding bottle device is less likely to leak. Further, since the passage prevention component is provided, liquid is prevented from reaching the air vent valve and thus the formation of bubbles all together can be eliminated.

In an embodiment the passage prevention component comprises a third passage formed as a one-way valve between the annular guidance duct and the confined volume. As an alternative, an opening or hole can be provided as a connection between the annular guidance duct and the confined volume, while a diameter of the hole is preferably set such that a passage of the less dense fluid, i.e. the outside air, be preferred to a passage of the fluid from within the container volume, e.g. milk, for instance.

In an embodiment the second passage opens into the annular guidance duct. Thereby, bubble formation is less likely to occur due to the annular guidance duct being connected with the container volume via the confined volume and the controlled opening.

In a further aspect a feeding method for feeding an infant is provided. The method comprises the steps of assembling a feeding bottle device according to the invention with liquid in a container component of the feeding bottle device, feeding the infant with the feeding bottle device maintained in an orientation of below 45 degrees, preferably below 30 degrees and particularly preferred between 10 and 30 degrees, relative to a horizontal axis. A teat volume within a teat component of the feeding bottle device is filled with liquid from a container volume of the container component through the first passage comprised in the partitioning component of the feeding bottle device. The first passage allows a more horizontal position of the feeding bottle device while maintaining the teat volume filled with liquid and thereby a favorable more vertical feeding position of the infant. The inclination does of course not have to be maintained throughout the entire feeding but can be varied as desired.

It shall be understood that a preferred embodiment of the present invention can also be any combination of the dependent claims or above embodiments with the respective independent claim.

These and other aspects of the invention will be apparent from and elucidated with reference to the embodiments described hereinafter.

DETAILED DESCRIPTION OF EMBODIMENTS

Figure 1:
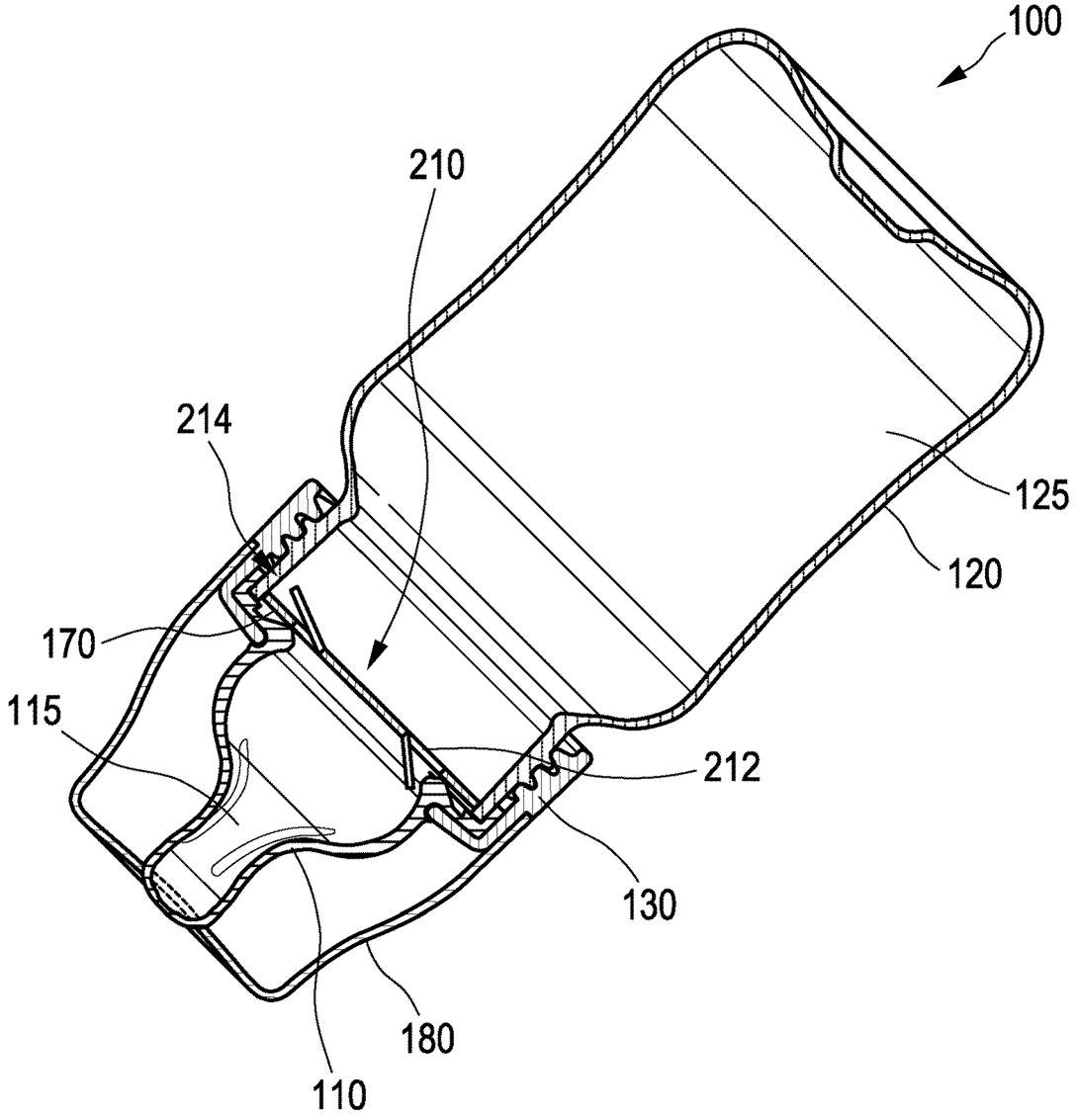
FIG. 1 shows schematically and exemplarily a feeding bottle device comprising a partitioning component according to the invention.

FIG. 1 schematically and exemplarily illustrates a feeding bottle device 100 in an assembled state in cross-sectional view. Feeding bottle device 100 comprises a teat component 110, which is attached to a container component 120 by means of an attachment component 130 in the form of a locking ring. Usually, feeding bottle device 100 and more precisely a container volume 125 within container component 120 is filled with milk, which is then fed to an infant out of teat component 110. For this purpose, feeding bottle device 100 in the assembled state illustrated in FIG. 1 is maintained at an angle which allows milk or other liquid to enter the teat volume 115 within teat component 110. The position in FIG. 1 corresponds to an operating position, in which feeding bottle device 100 is inclined such that a teat component 110 points downwards at a certain angle such that liquid enters a teat volume 115.

In a contact area between teat component 110 and container component 120 there is a partitioning component 210 provided, which separates teat volume 115 on one side and container volume 125 on the other side. The partitioning component 210 comprises a first passage 212 for allowing the passage of liquid from container volume 125 and an oppositely oriented second passage 214 for allowing the passage of air from teat component 115 to container volume 125.

First passage 212 is arranged at a lower position, i.e. significantly below the liquid level during most of the feeding session when the feeding bottle device 100 is maintained in the operating or feeding position exemplarily illustrated in FIG. 1, such that liquid can enter through first passage 212 into teat volume 115 which will always be essentially filled with liquid.

The provision of first passage 212 allows that teat volume 115 be filled with liquid even when the feeding bottle device 100 is maintained in a more horizontal feeding position than it would be possible with classical feeding bottle devices. A more horizontal position of feeding bottle device 100, preferably at an angle as low as below 45 degrees inclination with respect to the horizontal direction, corresponds to a more natural and more vertical feeding position of the infant, i.e. the feeding position while breast feeding, and is therefore preferred over a more inclined feeding position.

While usually the vacuum applied by the sucking action of the infant results in liquid being drawn into teat volume 115 through first passage 212, air entering into teat volume 115 through an opening of teat component 110 will also occur, for instance when the infant releases the latch. This air should not be ingested by the infant, which is the reason for second passage 214 being provided. Through second passage 214 air can escape from teat volume 115 into container volume 125. Since second passage 214 is located higher with respect to first passage 212 in the operating position illustrated in FIG. 1, it is more likely that second passage 214 be positioned above the level of liquid in container volume 125 such that no bubbles form when air enters into container volume 125 through second passage 214. The provision of first and second passages thereby results in less likelihood of air being ingested by the infant. In this example, both first 212 and second 214 passages are provided as one-way passages comprising a flap valve each, while other valves including duckbill valves can be employed in other examples. In other example only the second passage 214 can be formed as a one-way passage while the first passage 212 can allow a passage in both directions. Preferably, both first 212 and second 214 valves in this example have a very low, e.g. below 10 mbar, or no opening pressure, i.e. are nominally open, and further preferably also have a very low closing pressure.

Functioning of feeding bottle device 100 is described as follows. A caregiver assembles feeding bottle device 100 by usually inserting teat component 110 into attachment component 130, optionally then covering this assembly using a cap 180. Container component 120 is filled with milk and then partitioning component 210 is provided in the opening of container volume 125 before attachment component 130 is attached to container component 120, for instance by screwing it on.

Feeding bottle device 100 is then turned upside down, i.e. teat component 110 facing vertically down, to allow teat volume 115 to be filled with milk. Both first 212 and second 214 passages open allowing teat volume 115 to be filled with milk and the existing air in teat volume 115 to be vented into container volume 125 through second passage 214. The opening of both passages 212, 214 is due to their nominally open design combined with favorable hydrostatic pressure from the milk column in container volume 125.

Then, feeding bottle device 100 is turned into a feeding position with feeding bottle device 100 being oriented at less than 45 degrees with respect to a horizontal axis, preferably to a more vertical feeding position of the infant, i.e. feeding bottle device 100 being oriented only about 10 to 30 degrees with respect to the horizontal axis. In the feeding position, it is important that a rotational position is selected such that second one-way passage 214 is located on top. To assist in this purpose, a rotational orientation indication which indicates correct rotational orientation can be provided which will be described in further detail below.

As the infant drinks, the milk in teat volume 115 is emptied creating a lower pressure in teat volume 115 which closes second passage 214 but lets milk in through first passage 212 from container volume 125. Since first passage 212 is located below the liquid level surface, first passage 212 will only allow milk and no air to flow in. As mentioned, during the feed there is a possibility for air bubbles to enter teat volume 115 from the teat hole, for instance when the infant releases the latch. In such a situation, during subsequent feeding the bubbles are pushed through second passage 214 into container volume 125.

After finishing the feed, any milk left in teat volume 115 will drip into container volume 125 through either second passage 214 or first passage 214 due to gravity, when feeding bottle device 110 is placed vertical with teat component 110 facing vertically up.

Figure 2A:
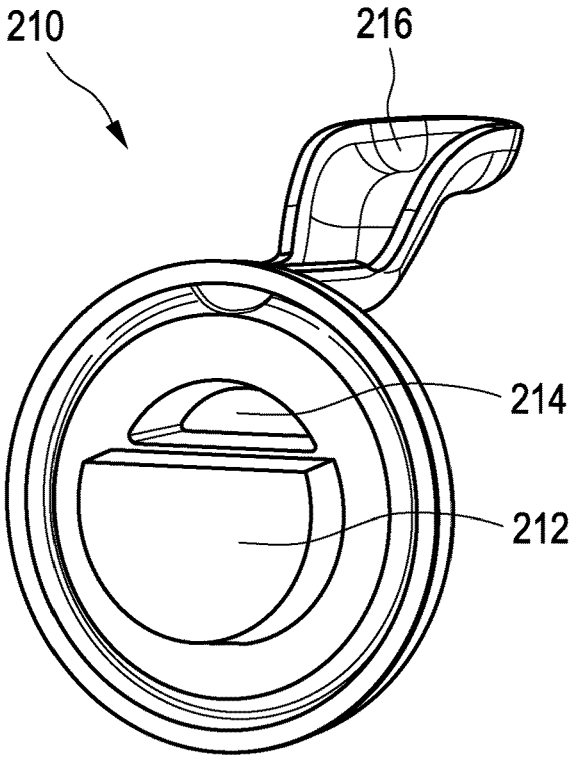
FIGS. 2A and 2B show schematically and exemplarily two perspective views on the partitioning component.
Figure 2B:
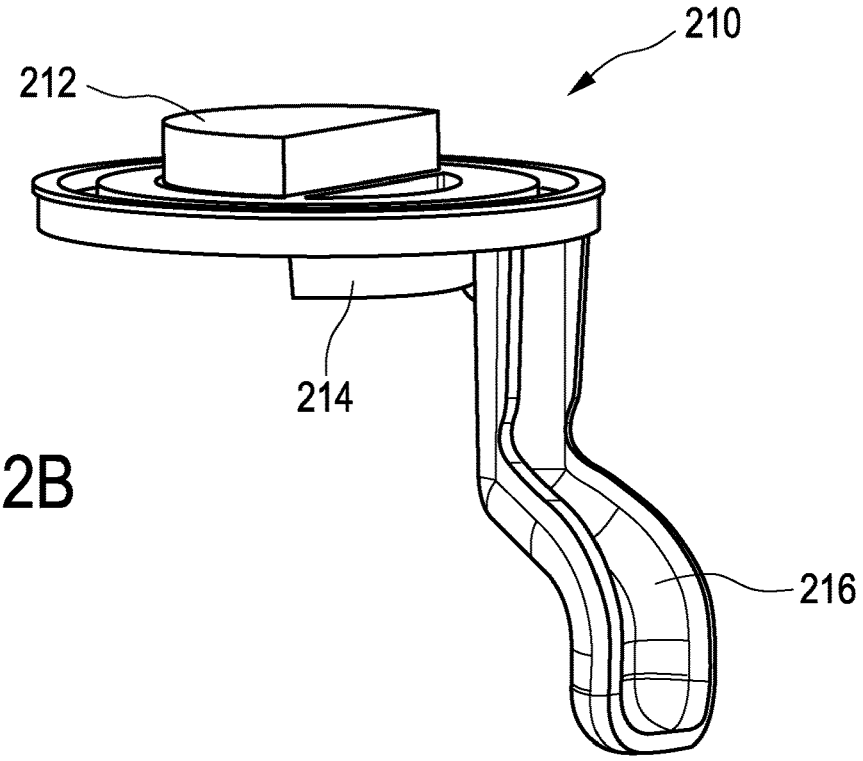

FIGS. 2A and 2B show two exemplary perspective views on partitioning component 210. In addition to first passage 212 and second passage 214, partitioning component 210 in this example comprises an orientation indicator 216. Orientation indicator 216 can then be located adjacent to a wall of container component 120 when feeding bottle device 100 is assembled and thereby indicate a rotational orientation of partitioning component 210, which is visible from outside. Second passage 214 is in this example closer to orientation indicator 216 than first passage 212 and will therefore more probably be above the liquid level throughout the feeding. Preferably, the orientation indicator 216 is intended to be positioned upside the feeding bottle device when used for feeding, while also other intended positions and/or additional orientation indicators can be provided in other examples. Preferably, the orientation indicator presents a color showing a good contrast versus milk.

While first passage 212 is generally larger than second passage 214, the invention is not limited thereto. Further, first passage 212 protrudes in this example from partitioning component 210 towards the teat volume 115 side and second passage 214 protrudes from partitioning component 210 towards the container volume 125 side, to which the invention is also not limited.

Figure 3:
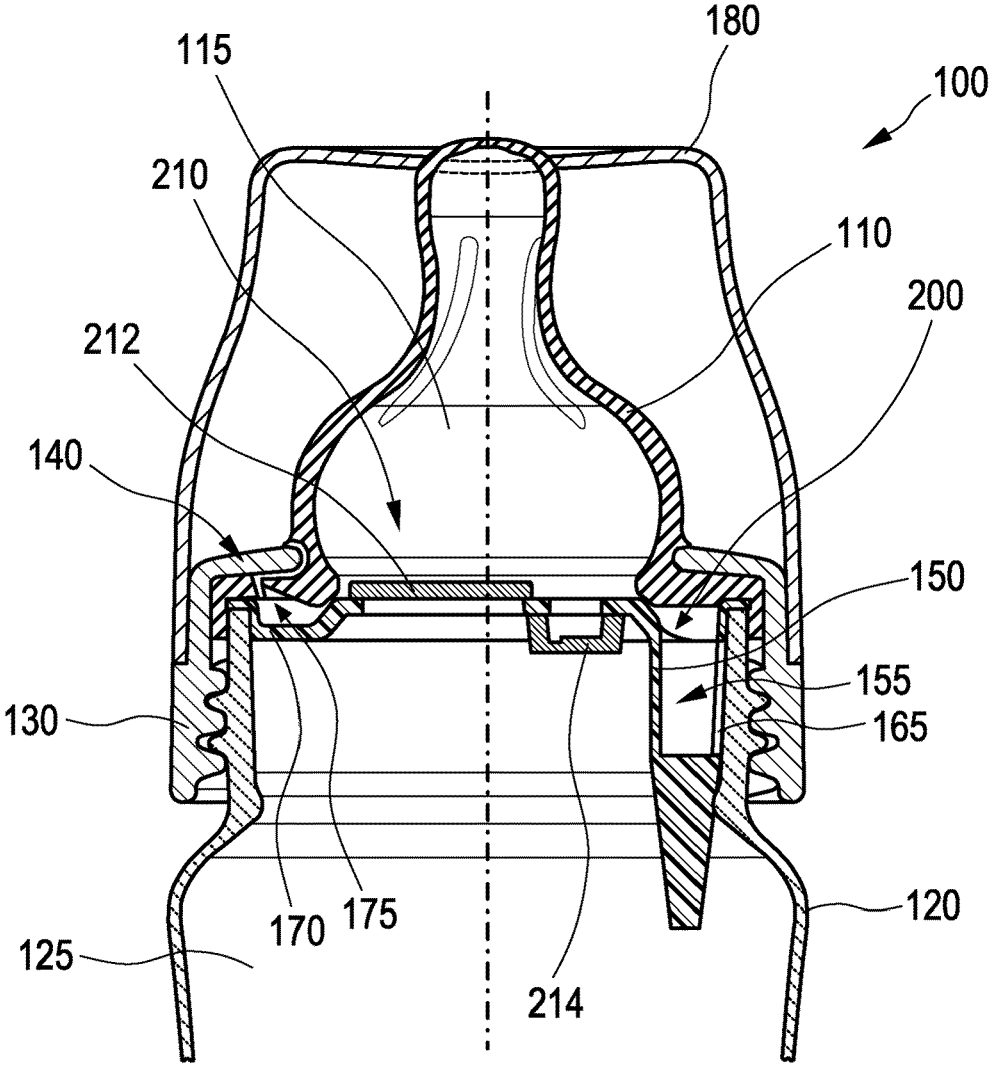
FIG. 3 shows schematically and exemplarily a feeding bottle device according to the invention.

FIG. 3 shows schematically and exemplarily a feeding bottle device 100 in an assembled state in cross-sectional view, as also illustrated in FIG. 1, with further features than can in other examples also be integrated into the examples of FIG. 1 and FIG. 2.

In the attachment area between teat component 110, container component 120 and attachment component 130, an air vent valve 140 for allowing air from outside of feeding bottle device 100 to enter into container volume 125 is provided. Thereby, the vacuum present in teat volume 115 while the infant is suckling to feed milk can be reduced, without air having to enter through teat component 110. Air entering through teat component 110 increases the risk of air being present within teat volume 115 and eventually entering the infant's mouth. Various forms of air vent valves 140 are known in the art, and can be, for instance, integrated within teat component 110, container component 120, attachment component 130, partitioning component 210 or an interface between any of these components.

Air enters through air vent valve 140 and gets collected in annular guidance duct 175 prior to entering container volume 125. Annular guidance duct 175 collects the air independent of an angular position of air vent valve 140 and guides it towards a confined volume 155. Adjacent to or as part of confined volume 155, a controlled opening 165 for releasing air into container volume 125 is provided. For this purpose, a duct forming component 170 extends annularly around an opening of container volume 125 and defines annular guidance duct 175 between duct forming component 170, container component 120 and/or teat component 110.

The exemplary shape of the annular guidance duct 175 of FIG. 3 is of course not the only feasible shape, other shapes of annular guidance duct 175 are contemplated in other examples. It is only of importance that annular guidance duct 175 be capable of connecting air entering through air vent valve 140 and guiding this air to confined volume 155. It should be further noted that guidance duct 175 is not necessarily to be provided in annular form around the opening of container volume 125, for instance, in case the angular position of air vent valve 140 is well known such as in a "must fit" layout, in which guidance duct 175 collects the air always at the same defined position of air vent valve 140.

In this example, confined volume 155 is defined by a confined volume forming component 150, which is provided adjacent a wall of container component 120. The confined volume 155 is thereby limited by confined volume forming component 150 and container component 120. In other examples, confined volume 155 can also be defined by confined volume forming component 150 only.

Between annular guidance duct 175 and confined volume 155, there is an optional passage prevention component 200 provided, which prevents the passage of liquid from container volume 125 towards air vent valve 140. Thereby, leaking of the feeding bottle device 100 can be prevented. Generally, in case liquid reaches air vent valve 140, the formation of bubbles is increased. It is therefore advantageous to not have any liquid in proximity of air vent valve 140. In one example, a one way valve can be provided as passage prevention component 200, which then prevents liquid from reaching air vent valve 140 and annular guidance duct 175 under typical use of feeding bottle device 100. However, also other suitable arrangements for preventing the passage of liquid from container volume 125 to air vent valve 140 can be employed in the alternative.

Figure 4:
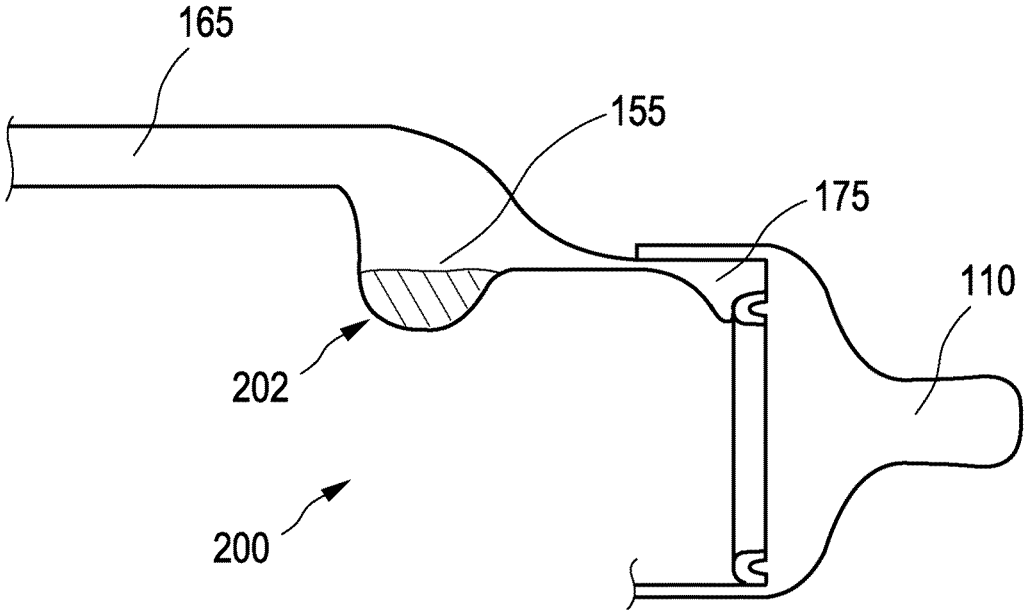
FIG. 4 shows schematically and exemplarily a reservoir deflection as a passage prevention component.

For example, another passage prevention component 200 is illustrated with reference to FIG. 4. FIG. 4 schematically and exemplarily illustrates a reservoir deflection 202 as passage prevention component 200. Reservoir deflection 202 forms a sufficiently large volume to trap any present liquid in the confined volume 155 and prevents it from reaching air vent valve 140. It is preferred that the volume of the reservoir formed by reservoir deflection 202 be larger than the expected volume of liquid within confined volume 155 when feeding bottle device 100 is in a resting position with teat component 110 pointing vertically upwards.

Returning to the example of FIG. 3, confined volume forming component 150 and duct forming component 170 are integrated within partitioning component 210 for separating container volume 125 from teat volume 115. Confined volume forming component 150 can, for instance, correspond to orientation indicator 216 as illustrated in FIG. 2. Partitioning component 210 fits between an opening of container component 120 and teat component 110 and creates two interfaces, one to each of the two components. Preferably, partitioning component provides a hard interface towards teat component 110 and a soft interface towards container component 120 to overcome leakage issues even though there is an additional part, partitioning component 210, present in the attachment area. Further, torsional strength of the assembly of attachment component 130, in particular in case it is formed as a screw ring, is not impacted. For this reason, partitioning component 210 may be manufactured using 2K injection molding processes, for instance. In other examples, partitioning component 210 may comprise a sealing material attached thereto which ensures the hard-soft interfaces between teat component 110, partitioning component 210 and container component, respectively.

Figure 5:
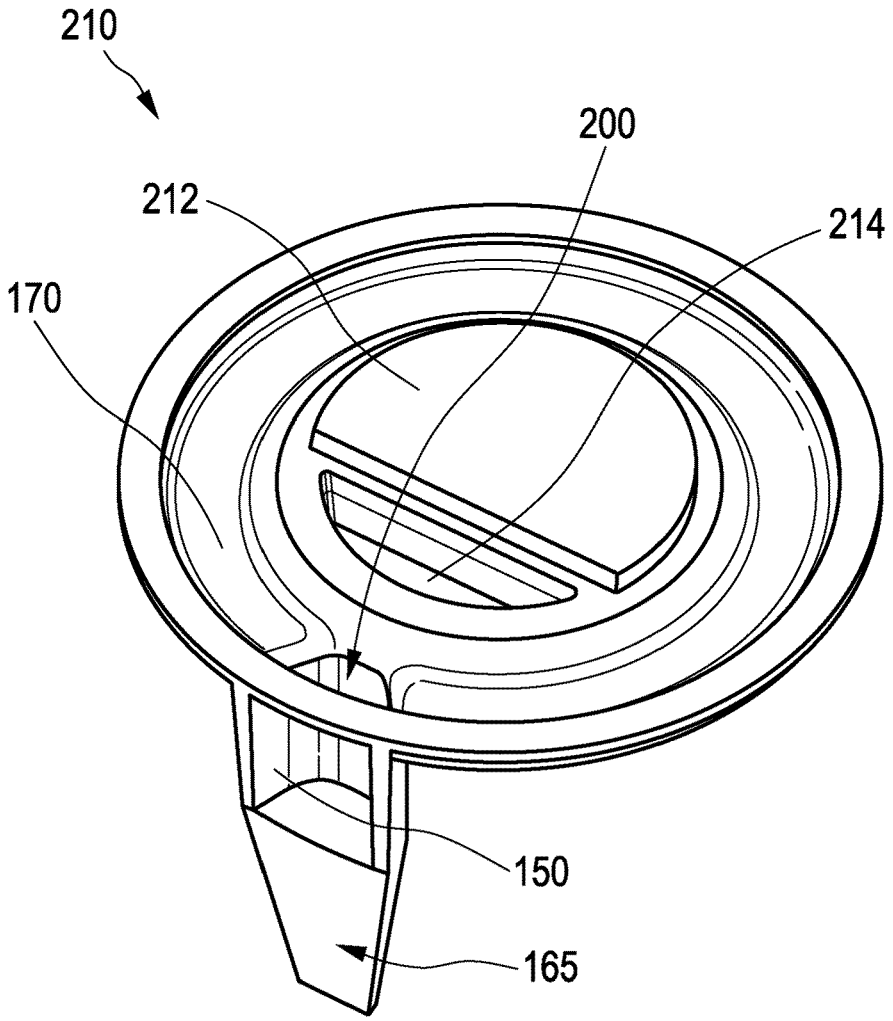
FIG. 5 shows schematically and exemplarily a partitioning component.

Another example of partitioning component 210 is schematically shown in further detail in FIG. 5, which illustrates particularly annular duct forming component 170 opening into confined volume forming component 150 through a passage prevention component 200. In the example of FIG. 5, first passage 212 and second passage 214 are formed as oppositely directed flap valves having respective hinge axes parallel to each other.

Figure 6A:
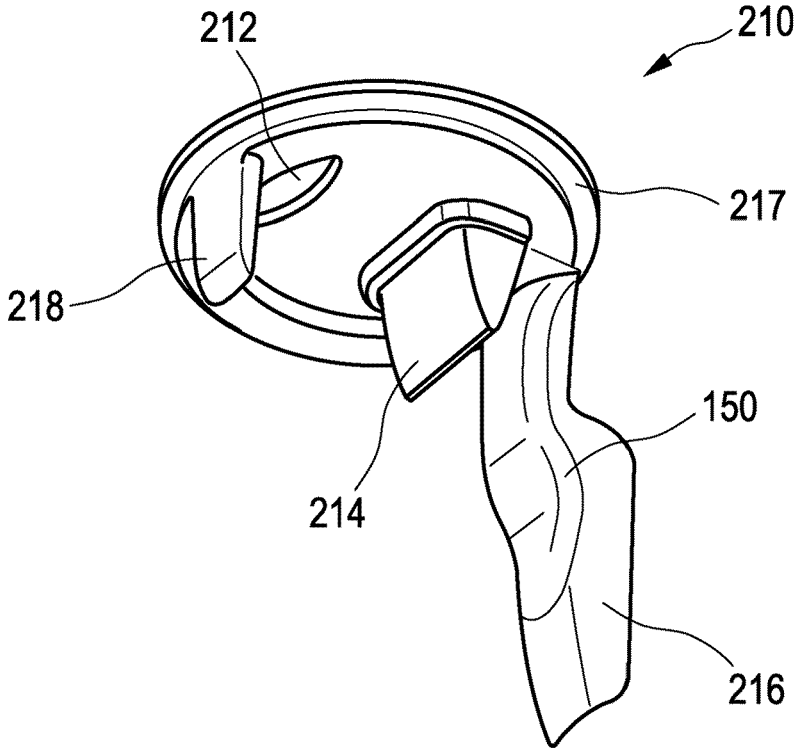
FIG. 6A shows schematically and exemplarily a further partitioning component in isolation.
Figure 6B:
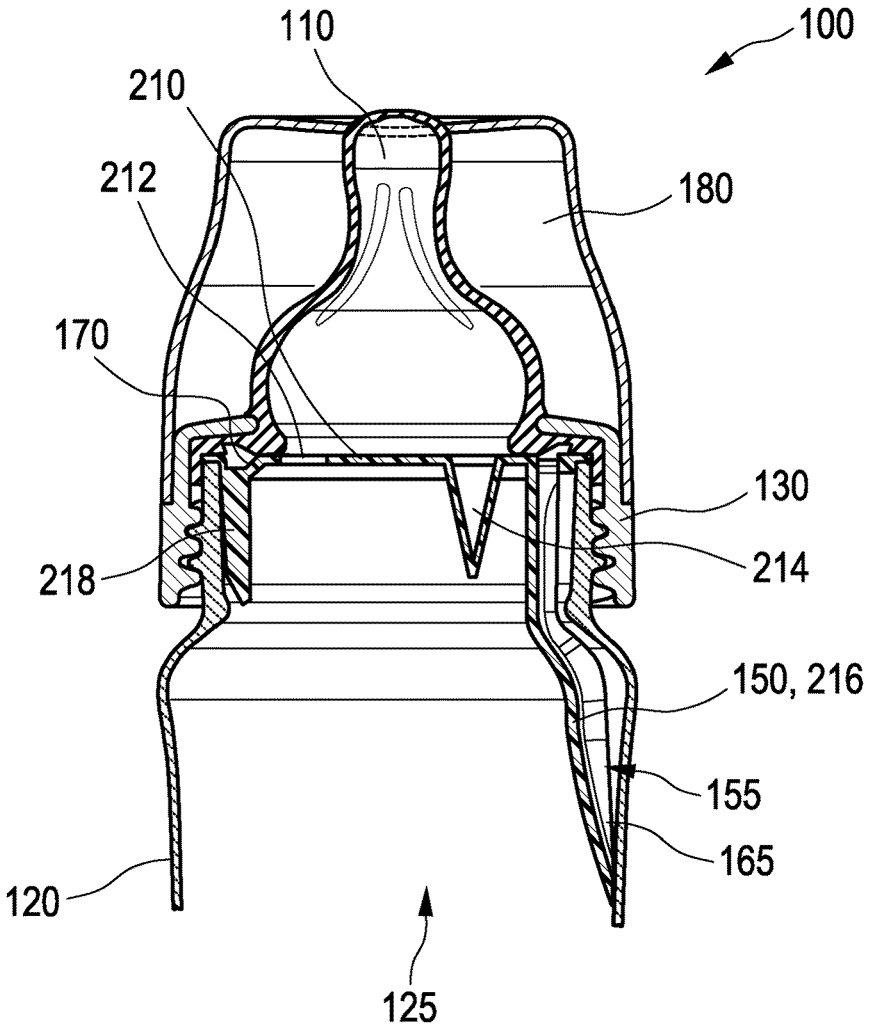
FIG. 6B shows schematically and exemplarily the partitioning component of FIG. 6A in an assembled state of the feeding bottle device.

Another example of partitioning component 210 is schematically shown in FIGS. 6A and 6B. While FIG. 6A illustrates partitioning component 210 in isolation, FIG. 6B illustrates the partitioning component 210 in an assembled state of feeding bottle device 100.

In this example, first passage 212 is formed as an opening with an exemplary elongated ellipsoidal shape in partitioning component 210. Second passage 214 comprises a duckbill valve which allows the passage of fluid, in particular air, from teat volume 115 to container volume 125 but blocks the passage of fluid in the opposite direction. The shape of the opening can of course be as desired.

Further, partitioning component 210 comprises a sealing material 217 at an interface to container component 120 in an assembled state. Sealing material 217 can integrally be formed with partitioning component 210 or be attached to partitioning component at a later stage and preferably comprise a soft material such that a sealing will be formed between container component 120 and partitioning component 210 after assembly of feeding bottle device 100. Likewise, the interface to teat component 110 preferably comprises a harder material such that also the interface between teat component 110 and partitioning component 210 will not leak.

A guiding component 218 having an exemplary tapered shape facilitates the assembly of partitioning component 210 into container component and provides a resistance against spring force from confined volume forming component 150 or orientation indicator 216. Confined volume forming component 150 or orientation indicator 216 comprises a flexible silicone for instance, which presses against the wall of container component 120.

In FIG. 6B confined volume 155 as defined between confined volume forming component 150 or orientation indicator 216 and a wall of container component 120 is clearly visible. Controlled opening 165 is formed at the portion of confined volume 155 which has the largest distance from teat component 110.

Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality.

A single unit, component or device may fulfill the functions of several items recited in the claims. The mere fact that certain measures are recited in mutually different dependent claims does not indicate that a combination of these measures cannot be used to advantage.

The invention claimed is:

1. A device comprising a partitioning component and a feeding bottle, the feeding bottle comprising: a teat component defining a teat volume therein, and a container component defining a container volume therein, an attachment component, the teat component being attachable to the container component by means of the attachment component, the partitioning component arranged to separate the teat volume from the container volume when the feeding bottle is assembled, the feeding bottle further comprising:

at least one air vent valve located in an attachment area of the attachment component at an arbitrary rotational position about a circumference of the attachment area, configured to allow the passage of air from outside the feeding bottle device to within the teat volume or the container volume thereby reducing a vacuum in the teat volume whilst an infant is suckling from the teat component, a confined volume forming component provided adjacent a wall of the container component, arranged to define a confined volume within the container volume, wherein the confined volume provides a controlled opening for releasing air into the container volume, and a duct forming component for forming an annular guidance duct around a circumference of a contact area between the teat component and the container component, the duct extending from the at least one air vent valve to the confined volume, the duct configured for collecting air independent of the angular position of the air vent valve and guiding the air towards the confined volume to be released into the container volume via the controlled opening in a controlled manner, the partitioning component comprising:

a first passage allowing a passage of fluid from the container volume to the teat volume, a second passage allowing a passage of fluid from the teat volume to the container volume, a guiding component arranged to guide the partitioning component into an opening of the container component, wherein the second passage is provided in the form of a one-way passage, wherein the first passage and the second passage are integrated within the partitioning component, and wherein the second passage is located higher with respect to the first passage in an operating position of the feeding bottle device.

2. The device comprising a partitioning component and a feeding bottle according to claim 1, further comprising an orientation indicator configured to be visually noticeable when the feeding bottle device is assembled.

3. The device comprising a partitioning component and a feeding bottle according to claim 2, wherein the first passage and the second passage are arranged at different distances from the orientation indicator, respectively.

4. The device comprising a partitioning component and a feeding bottle according to claim 3, wherein the second passage is arranged closer to the orientation indicator than the first passage.

5. The device comprising a partitioning component and a feeding bottle according to claim 1, wherein at least one of the first passage and the second passage comprises a valve presenting an opening pressure of 10 mbar or below.

6. The device comprising a partitioning component and a feeding bottle according to claim 1, wherein at least one of the first passage and the second passage comprises a flap valve or a duckbill valve.

7. The device comprising a partitioning component and a feeding bottle according to claim 1, wherein the first passage is formed as an opening.

8. The device comprising a partitioning component and a feeding bottle according to claim 7, wherein the first passage is formed as an opening with elliptical shape.

9. The device comprising a partitioning component and a feeding bottle according to claim 1, further comprising a sealing material for forming a sealing interface between the partitioning component and at least one of the teat component and the container component.

10. The partitioning component according to claim 1, wherein the confined volume forming component and the duct forming component are integrated in the partitioning component for dividing the teat volume from the container volume when the feeding bottle device is assembled.

11. The partitioning component according to claim 1, further comprising a third passage preventing a passage of fluid from the confined volume to the at least one air vent valve.

12. The partitioning component according to claim 11, wherein the third passage is formed as a one-way valve.

13. The partitioning component according to claim 1, wherein the second passage opens into the annular guidance duct.

14. A feeding bottle device comprising:

a teat component defining a teat volume therein, a container component defining a container volume therein, a partitioning component comprising a first passage allowing a passage of fluid from the container volume to the teat volume and a second passage allowing a passage of fluid from the teat volume to the container volume, wherein the second passage is provided in the form of a one-way passage, wherein the first passage and the second passage are integrated within the partitioning component, wherein the partitioning component further comprises a guiding component for guiding the partitioning component into an opening of the container component, and wherein the second passage is located higher with respect to the first passage in an operating position of the bottle feeding device, an attachment component, the teat component the container component and the partitioning component being attachable to each other along a contact area by means of the attachment component, and at least one air vent valve located in the attachment area of the attachment component at an arbitrary rotational position about the circumference of the attachment area, configured to allow the passage of air from outside the feeding bottle device to within the teat volume or the container volume thereby reducing a vacuum in the teat volume whilst an infant is suckling from the teat component, a confined volume forming component provided adjacent a wall of the container component, arranged to define a confined volume within the container volume, wherein the confined volume provides a controlled opening for releasing air into the container volume, and a duct forming component for forming an annular guidance duct around a circumference of a contact area between the teat component and the container component, the duct extending from the at least one air vent valve to the confined volume, the duct configured for collecting air independent of the angular position of the air vent valve and guiding the air towards the confined volume to be released into the container volume via the controlled opening in a controlled manner.

15. The feeding bottle device according to claim 14, wherein the confined volume forming component and the duct forming component are integrated in the partitioning component for dividing the teat volume from the container volume when the feeding bottle device is assembled.

16. The feeding bottle device according to claim 14, further comprising a third passage preventing a passage of fluid from the confined volume to the at least one air vent valve.

17. The feeding bottle device according to claim 16, wherein the third passage is formed as a one-way valve.

18. The feeding bottle device according to claim 14, wherein the second passage opens into the annular guidance duct.

19. A partitioning component for a feeding bottle device, the partitioning component being configured to separate a teat volume of a teat component of the feeding bottle from a container volume of a container component of the feeding bottle when the feeding bottle device is assembled, wherein the partitioning component comprises a first passage allowing a passage of fluid from the container volume to the teat volume and a second passage allowing a passage of fluid from the teat volume to the container volume, wherein the second passage is provided in the form of a one-way passage, wherein the first passage and the second passage are integrated within the partitioning component, and wherein the partitioning component further comprises a guiding component for guiding the partitioning component into an opening of the container component, and wherein the first passage and the second passage are formed as oppositely directed flap valves having respective hinge axes parallel to each other, and wherein the second passage is located higher with respect to the first passage in an operating position of the feeding bottle device.

20. The partitioning component according to claim 19, further comprising a third passage preventing a passage of fluid from the confined volume to the at least one air vent valve.

21. The partitioning component according to claim 20, wherein the third passage is formed as a one-way valve.

* * * * *